US007480955B2

(12) United States Patent
Hohlbein et al.

(10) Patent No.: US 7,480,955 B2
(45) Date of Patent: Jan. 27, 2009

(54) TOOTHBRUSH

(75) Inventors: Douglas J. Hohlbein, Pennington, NJ (US); Thomas Mintel, Rahway, NJ (US); Bruce Russell, Howell, NJ (US); Kenneth Waguespack, North Brunswick, NJ (US); Urs Troxler, Schlierbach (CH)

(73) Assignee: Colgate-Palmolive Company, New York, NY (US)

( * ) Notice: Subject to any disclaimer, the term of this patent is extended or adjusted under 35 U.S.C. 154(b) by 21 days.

(21) Appl. No.: 11/530,290

(22) Filed: Sep. 8, 2006

(65) Prior Publication Data

US 2007/0056128 A1 Mar. 15, 2007

Related U.S. Application Data

(60) Provisional application No. 60/715,140, filed on Sep. 9, 2005.

(51) Int. Cl.
*A47L 13/00* (2006.01)

(52) U.S. Cl. ..... 15/111; 15/167.1; 15/207.2

(58) Field of Classification Search ..... 15/167.1, 15/207.2, 110, 111, DIG. 5; 601/141; D4/104, D4/105, 108
See application file for complete search history.

(56) References Cited

U.S. PATENT DOCUMENTS

| | | | | |
|---|---|---|---|---|
| 1,091,090 | A | 3/1914 | Tacail | |
| 1,254,532 | A | 1/1918 | Paul | |
| 1,503,050 | A | 7/1924 | Jurk et al. | |
| 1,643,217 | A | 9/1927 | Lazarus | |
| 1,693,229 | A * | 11/1928 | Felmar | 15/167.1 |
| 2,103,083 | A | 12/1937 | Lynch | |
| 2,175,975 | A | 10/1939 | Steiner | |
| 2,246,867 | A | 6/1941 | Thomas et al. | |
| 2,464,321 | A * | 3/1949 | Konczal | 15/167.1 |
| 3,230,562 | A | 1/1966 | Birch et al. | |
| 5,269,038 | A | 12/1993 | Bradley | |
| 5,398,366 | A | 3/1995 | Bradley | |
| 5,459,898 | A | 10/1995 | Bacolot | |
| 5,903,951 | A | 5/1999 | Ionta et al. | |
| 6,230,355 | B1 * | 5/2001 | Harada | 15/167.1 |
| 6,253,404 | B1 | 7/2001 | Boland et al. | |
| 6,389,634 | B1 | 5/2002 | Devlin et al. | |
| 6,471,300 | B1 | 10/2002 | Tomiyama | |
| 6,477,729 | B1 | 11/2002 | Ben-Ari | |
| 6,823,554 | B1 | 11/2004 | Braun et al. | |
| 6,826,797 | B1 | 12/2004 | Chenvainu et al. | |
| 6,918,154 | B2 | 7/2005 | Ben-Ari | |
| 6,993,804 | B1 * | 2/2006 | Braun et al. | 15/110 |
| 2004/0128784 | A1 | 7/2004 | Ben-Ari | |
| 2004/0255416 | A1 | 12/2004 | Hohlbein | |

(Continued)

FOREIGN PATENT DOCUMENTS

| | | |
|---|---|---|
| EP | 1 147 750 A1 | 10/2001 |

(Continued)

*Primary Examiner*—Dung Van Nguyen
(74) *Attorney, Agent, or Firm*—Donald L. Traut

(57) ABSTRACT

A toothbrush includes a head and a plurality of tooth cleaning elements for enhanced cleaning of the teeth. The tooth cleaning elements include cleaning elements that define a radial array arrangement for better retention of the dentifrice. A radial array may be strategically disposed in an off-axis arrangement within other cleaning elements on the head.

20 Claims, 9 Drawing Sheets

U.S. PATENT DOCUMENTS

2005/0000049 A1* 1/2005 Hohlbein ..... 15/111

FOREIGN PATENT DOCUMENTS

EP 1 258 227 A2 11/2002
GB 2 071 558 A 9/1981
WO WO 97/41754 11/1997
WO WO 98/57569 12/1998
WO WO 02/11583 2/2002

* cited by examiner

TOOTHBRUSH

CROSS REFERENCE TO RELATED APPLICATION

This application is a non-provisional application of U.S. Patent Application No. 60/715,140, filed on Sep. 9, 2005, in which the contents are incorporated by reference.

FIELD OF THE INVENTION

The present invention pertains to a toothbrush with an improved cleaning head and manufacturing method.

BACKGROUND OF THE INVENTION

A toothbrush is used to clean the teeth by removing plaque and debris from the tooth surfaces. Conventional toothbrushes provided with tufts of bristles and multi-part wheeled hub designs have drawbacks. During the brushing process, dentifrice slips through the tufts of bristles and away from the contact between the bristles and the teeth. As a result, the dentifrice often is spread around the mouth. Therefore, the efficiency of the cleaning process is greatly reduced.

Another drawback of a multi-part wheeled design is the need for space on the sides of the wheels to mount the hubs. The areas adjacent to the hubs must be free of bristles, as the bristle mounting would interfere with the hub function. Large areas of brush head interior that are devoid of bristles greatly reduce cleaning efficiency of conventional toothbrushes. Furthermore, assembled wheeled hub designs have multiple parts to track and assemble. The assembly time and tracking of the parts can be costly in a manufacturing operation.

Hence, there is a need for a toothbrush with a radial design which increases the cleaning effectiveness and is more efficient to manufacture.

SUMMARY OF THE INVENTION

The invention pertains to a toothbrush with radial oriented cleaning elements to provide enhanced cleaning of a user's teeth.

In one embodiment, a toothbrush includes a head with a group of tooth cleaning elements generally defining a radial array being integral with the head. In one construction, each radial array is formed by a plurality of independently flexible cleaning elements so as to maintain user comfort and provide improved cleaning of the teeth.

In one embodiment, a toothbrush includes a radial array with a fluid retaining portion for retaining dentifrice on the toothbrush to intensify the cleaning action.

In one embodiment, a radial array of cleaning elements is strategically oriented at an angle to the longitudinal axis of head to maximize the cleaning effect of brushing motions for overall improved cleaning of the teeth, including the interproximal areas between the teeth, along the gum line, and the lingual and facial side surfaces of the teeth.

In one embodiment, there is provided a method of manufacturing a toothbrush head. A base of a toothbrush head is molded in a first direction that may be vertical, horizontal or at an angle. In a subsequent operation, at least one radial array is molded on to the base of the toothbrush head. The mold halves forming the radial array move in a second direction that is different from the first direction.

DETAILED DESCRIPTION OF THE INVENTION

Figure 1:
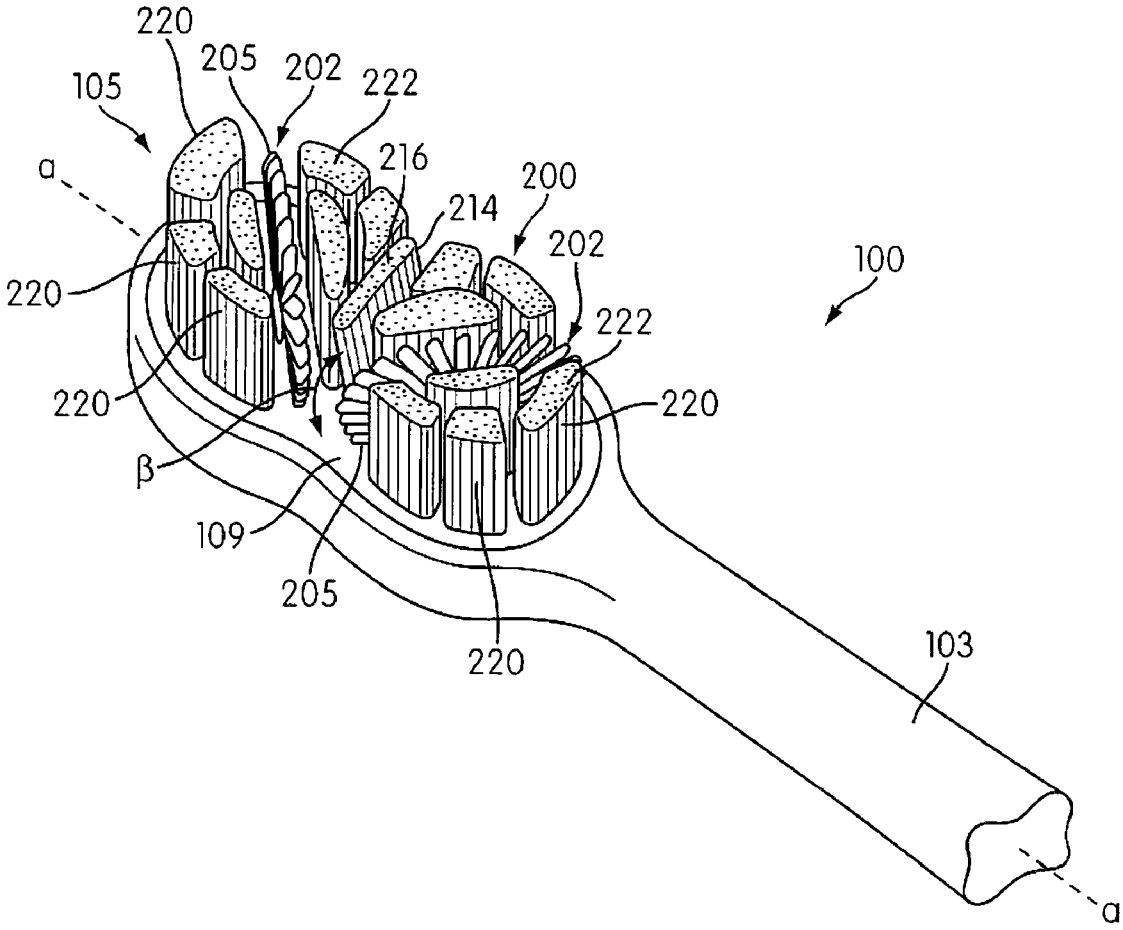
FIG. 1 is a enlarged perspective view of an embodiment of a toothbrush according to the teaching of the invention.

A toothbrush 100 is shown in FIGS. 1-3A having a handle 103 and a head 105, and tooth cleaning elements 200 for cleaning a user's teeth. Handle 103 is provided for the user to readily grip and manipulate the toothbrush 100, and may be formed of many different shapes and with a variety of constructions.

Tooth cleaning elements 200 can include filament bristles or elastomeric fingers or walls which are used for wiping, cleaning and/or massaging the user's oral tissue. Other tooth cleaning elements of other constructions that are known in the art could be used. The tooth cleaning elements can be attached to a base plate 109 of head 105 by any known manner, such as via anchor free tufting. The base plate 109 is preferably tufted and formed separately and then inserted into a socket in the head.

Head 105 is provided with one or more radial arrays 202 of radial tooth cleaning elements 205 (e.g., spokes) to maximize the cleaning effect of brushing motions for overall improved cleaning of the teeth, including the interproximal areas between the teeth, along the gum line, and the lingual and facial side surfaces of the teeth. The radial tooth cleaning elements or spokes 205 can have a constant cross-section of any shape and size, or a variable cross-section that results in, for example, a spoke that tapers from a larger cross-section to a smaller cross-section at the tip of the spoke. Each spoke could also have a distal, free end cross-section that is angled relative to the longitudinal axis of the spoke so that the spoke resists bending or deflecting downward during brushing. Radial arrays 202 translate longitudinal brushing motion along longitudinal axis a-a into a transverse motion component and a longitudinal motion component for improved cleaning. In one construction, the radial arrays 202 are formed by a plurality of independently flexible cleaning spokes 205 so as to maintain user comfort and provide improved cleaning of the teeth.

Figure 2:
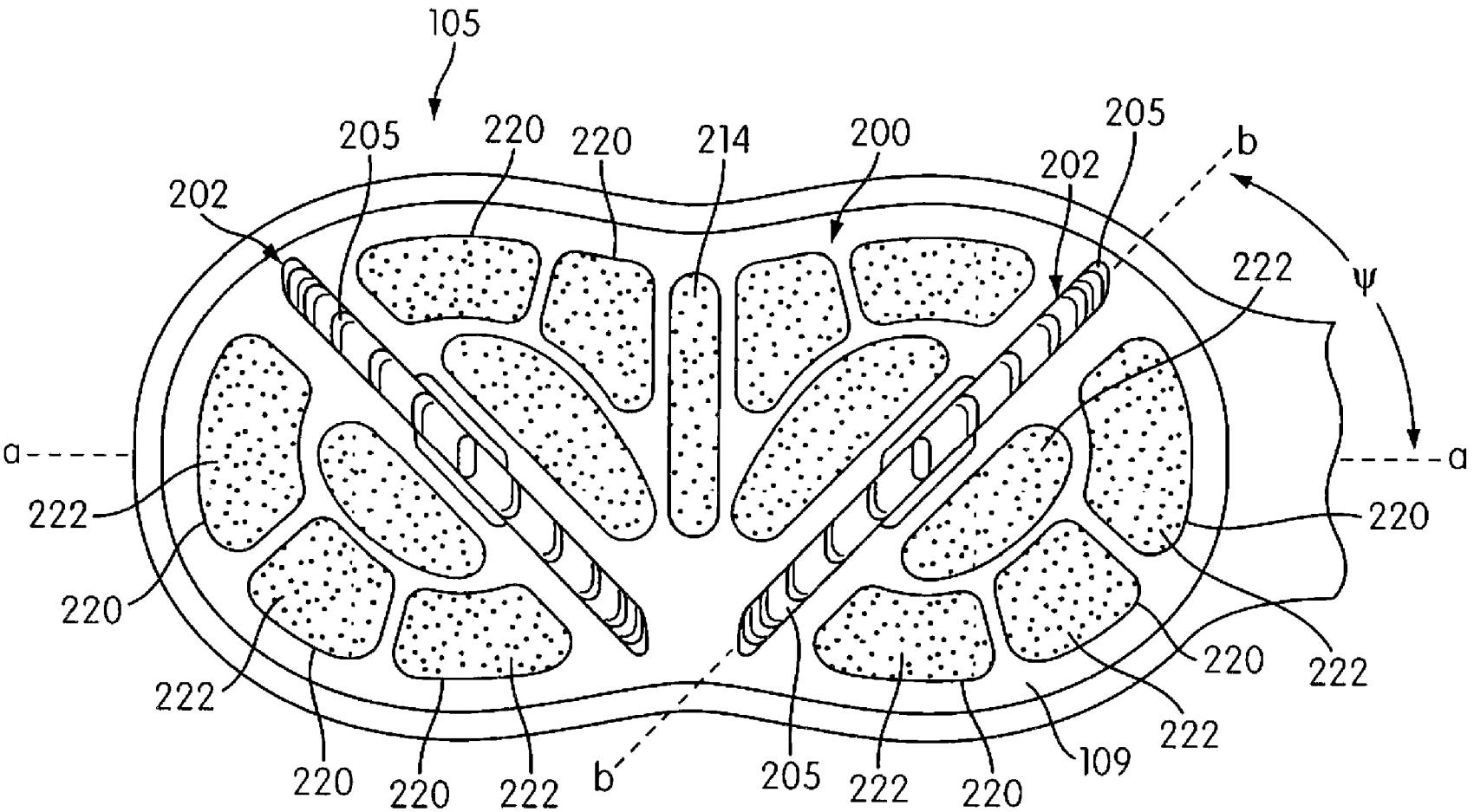
FIG. 2 is a plan view of a head of the toothbrush of FIG. 1.

As shown in FIG. 2, in one embodiment, two radial arrays 202 are each positioned front to back along longitudinal axis a-a and the longitudinal axis b-b of radial arrays 202 are offset at an angle $\psi$ from longitudinal axis a-a. In one example, the angle $\psi$ can range between 20 to 90 degrees or preferably be at 45 degrees. Nevertheless, other angles are possible. In alternative constructions, the radial arrays 202 can be arranged in other patterns including non-aligned arrangements or positioned away from the longitudinal axis a-a, for example on either side of the axis a-a. In this manner, more tooth surfaces can be cleaned as well as a greater quantity of dentifrice can be retained on the toothbrush head 105. Nevertheless, more than two arrays can be provided on the toothbrush 100.

Figure 4:
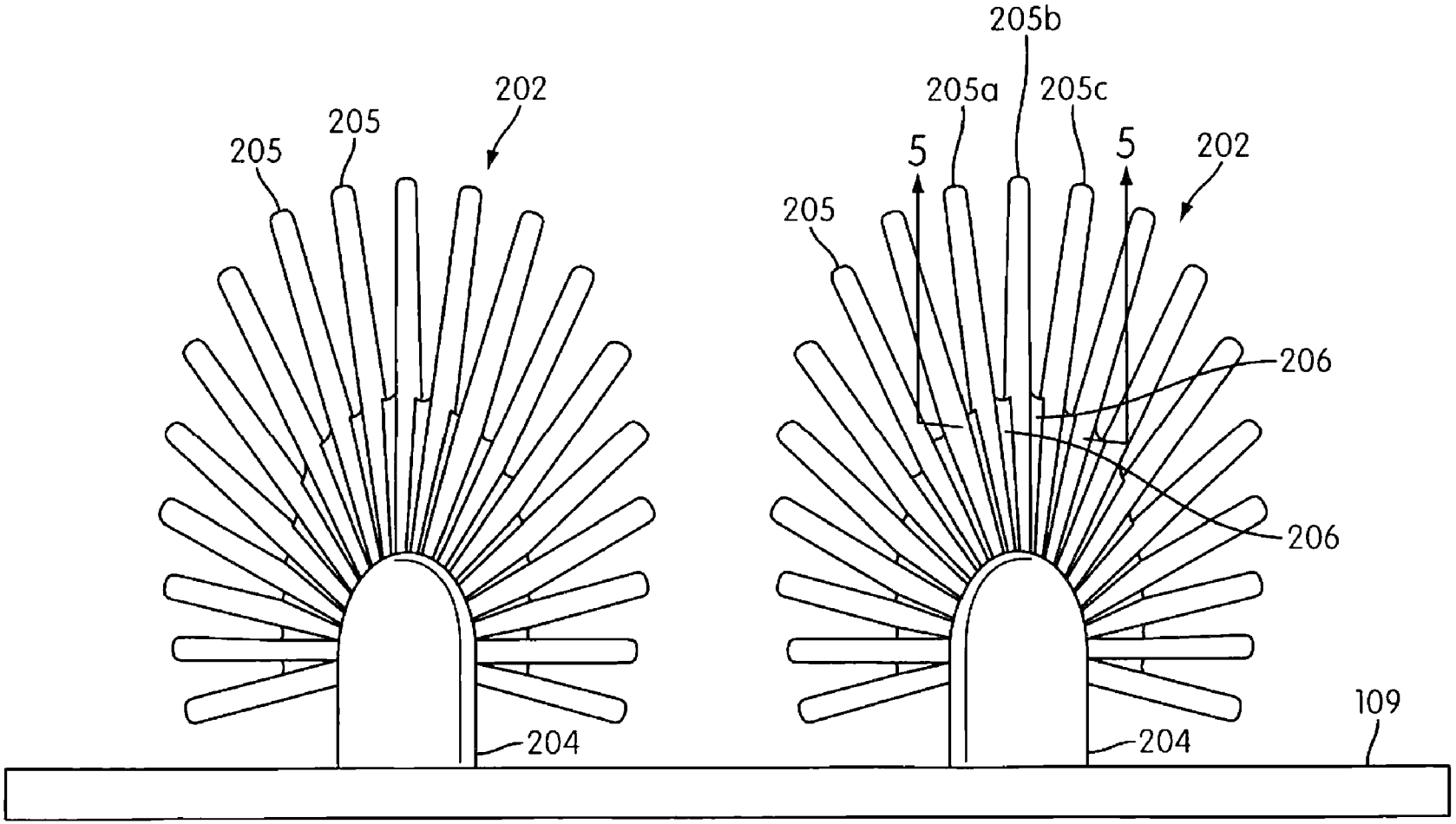
FIG. 4 is an enlarged side view of a portion of the toothbrush of FIG. 1 showing a radial array construction in isolation for clarity.
Figure 5:
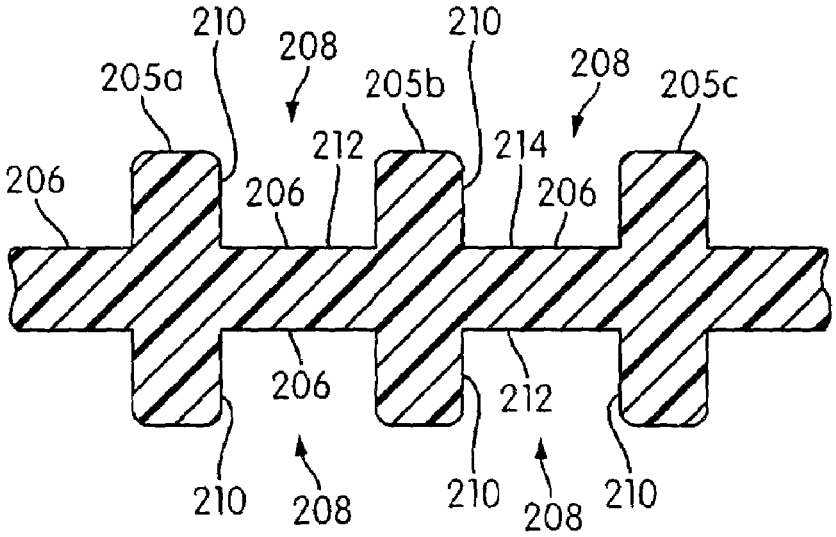
FIG. 5 is a partial section view of the radial array construction taken along line 5-5 of FIG. 4.

In one embodiment, enhanced cleaning is accomplished by retaining a portion of dentifrice that would normally wash through the spokes and influencing the retained dentifrice to flow towards the tip of the radial tooth cleaning elements. As shown in FIG. 4, the radial array 202 includes a fixed upstanding hub 204 and a series of joining segments or fluid retaining portions 206 provided in the gaps between adjacent spokes 205*a-c*. As seen in the partial cross-section view of FIG. 5, a flow channel 208 is defined by the fluid retaining portion 206 and sidewall portions 210 of the adjacent spokes 205*a-c*. A base surface 212 of the flow channel 208 is formed by the fluid retaining portion 206. The sidewalls 210 of the flow channel 208 are formed by the adjacent spokes 205*a-c*. This flow channel acts as a catch basin for concentrating dentifrice on the head 105 during brushing.

While the fluid retaining portion 206 is shown between all of tie adjacent spokes, the fluid retaining portion can be provided between a lesser number of adjacent spokes. Hence, a desired effectiveness or amount of cleaning power can be controlled by a manufacturer of the toothbrush. While the lower end of the fluid retaining portion is shown molded to the hub 204, the fluid retaining portion may be disconnected or separate from the hub. The hub 204 may be constructed to prevent movement of the radial array as a whole along its axis, or it may be constructed to allow for movement of the radial array along an axis that is normal to the radial axis. Alternatively, the hub 204 may be constructed to allow the radial array to rock, pivot or flex relative to the base plate 109 in a variety of directions.

Figure 3A:
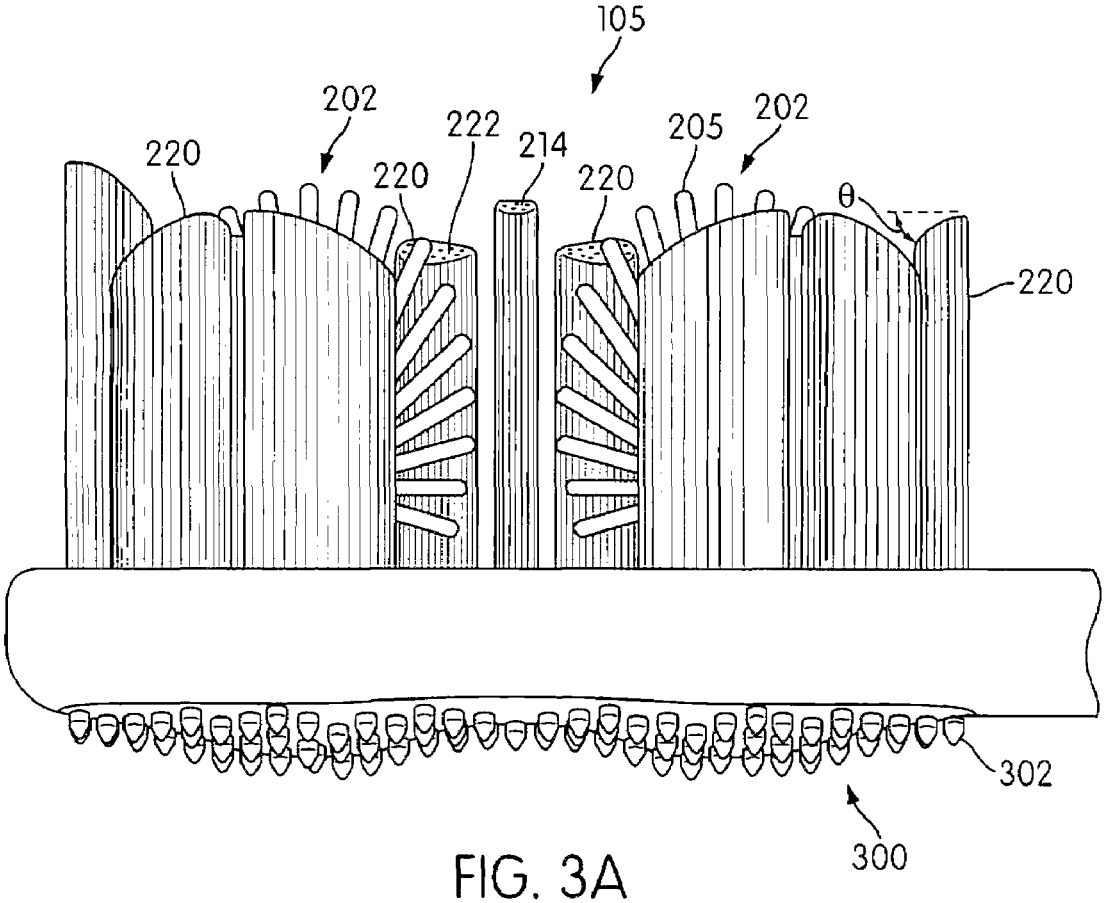
FIG. 3A is a side view of a head of the toothbrush of FIG. 1.

In FIG. 2, in one embodiment, the tips of the spokes 205 protrude from the side of the bristle field of the head 105. The extended side arrangement of the spokes provides for improved interproximal cleaning as well as broad tooth surface cleaning during a rolling motion of the head 105 about longitudinal axis a-a. Referring to FIG. 3A, the spokes 205 extend vertically higher above the base plate 109 than the other tooth cleaning elements, such as the bristle tufts 220. This configuration also provides deeper penetration of the spokes 205 between the interproximal space between the user's teeth.

In FIG. 3A, each of the bristle tufts 220 have tips which collectively and preferably define a chamfered brushing surface 222 that is angled inwardly towards radial arrays 202 in the interior of the head 105. By way of example, brushing surface 222 is preferably at an angle Ø of about 30 degrees to base plate 109, but may also range between 10-50 degrees. It should be recognized that other angular values are possible, and that the chamfer could vary for each tuft. The angular nature of the tufts 220 allows dentifrice to stay longer on the toothbrush head 105 during a brushing operation, rather than being spread into the mouth. Hence, this angular configuration provides a directed concentration of dentifrice on the radial arrays 202 to enhance the cleaning action during the sweeping or oscillating motion of the toothbrush head 105.

Figure 3B:
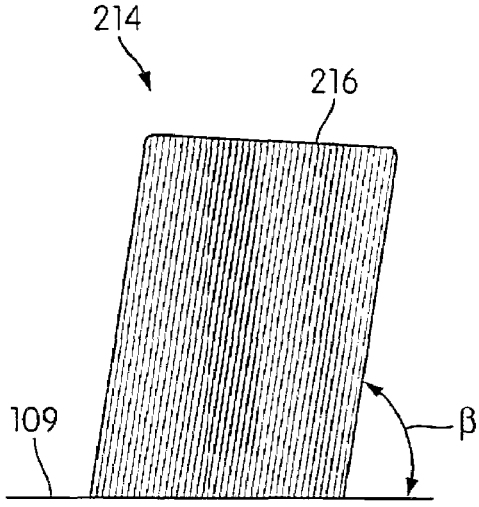
FIG. 3B is front view of the head of the toothbrush of FIG. 1 showing a central bristle tufts in isolation for clarity.

In FIG. 3B, a central bristle tuft 214 is provided at an acute angle β with respect to the base plate 109 in which the tips define a brushing surface 216 that directs dentifrice in the direction of radial arrays 202. In one example, the acute angle can range between 10 to 89 degrees. Nevertheless, other angles are possible. In this way, an incremental portion of dentifrice is retained on the radial array to intensify the cleaning action of the toothbrush 100. With this arrangement, dentifrice provided from the brushing surface 216 can be retained on the fluid retaining portion 206 of the radial array 202 for more efficient tooth cleaning. The angle of the central bristle tuft 214 toward the convergence of the radial arrays 202 also creates the appearance of the tuft 214 filling in the space between the radial arrays 202.

Figure 6:
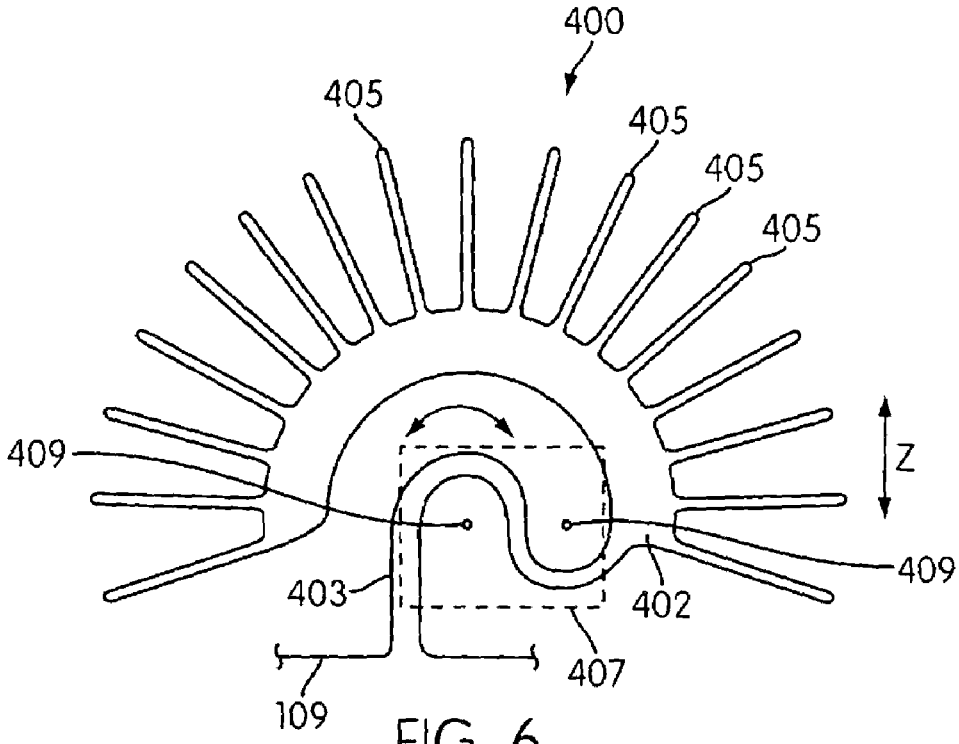
FIG. 6 is a side view of an alternative embodiment of a radial array construction in isolation for clarity.

FIG. 6 illustrates an alternative embodiment of a radial array 400. At least one mounting stem or biasing member 403 extends from the base plate 109 to a central hub 402. In this way, the hub 402 is vertically spaced from the base plate 109. The stem 403 is independently flexible or resilient for biased side-to-side motion. This flexible arrangement enables the hub 402 and spokes 405 to pivot together as one unit. Of course, the spokes 405 can be independently flexible or somewhat stiffer. This construction of a flexible stem 403 and spokes 405 enable compound brushing motions from a single sweep of the toothbrush. In a further construction, the mounting stem 403 includes a coiled spring arrangement 407 defining a non-linear biasing member 403 so that a vertical depression (e.g. z-direction compression) of the spokes 405 influences a rotary or pivoting motion of the hub 402. In this non-linear construction, the pivot center 409 is provided above the base plate 109 and offset from a vertical axis of the member 403.

Figure 7:
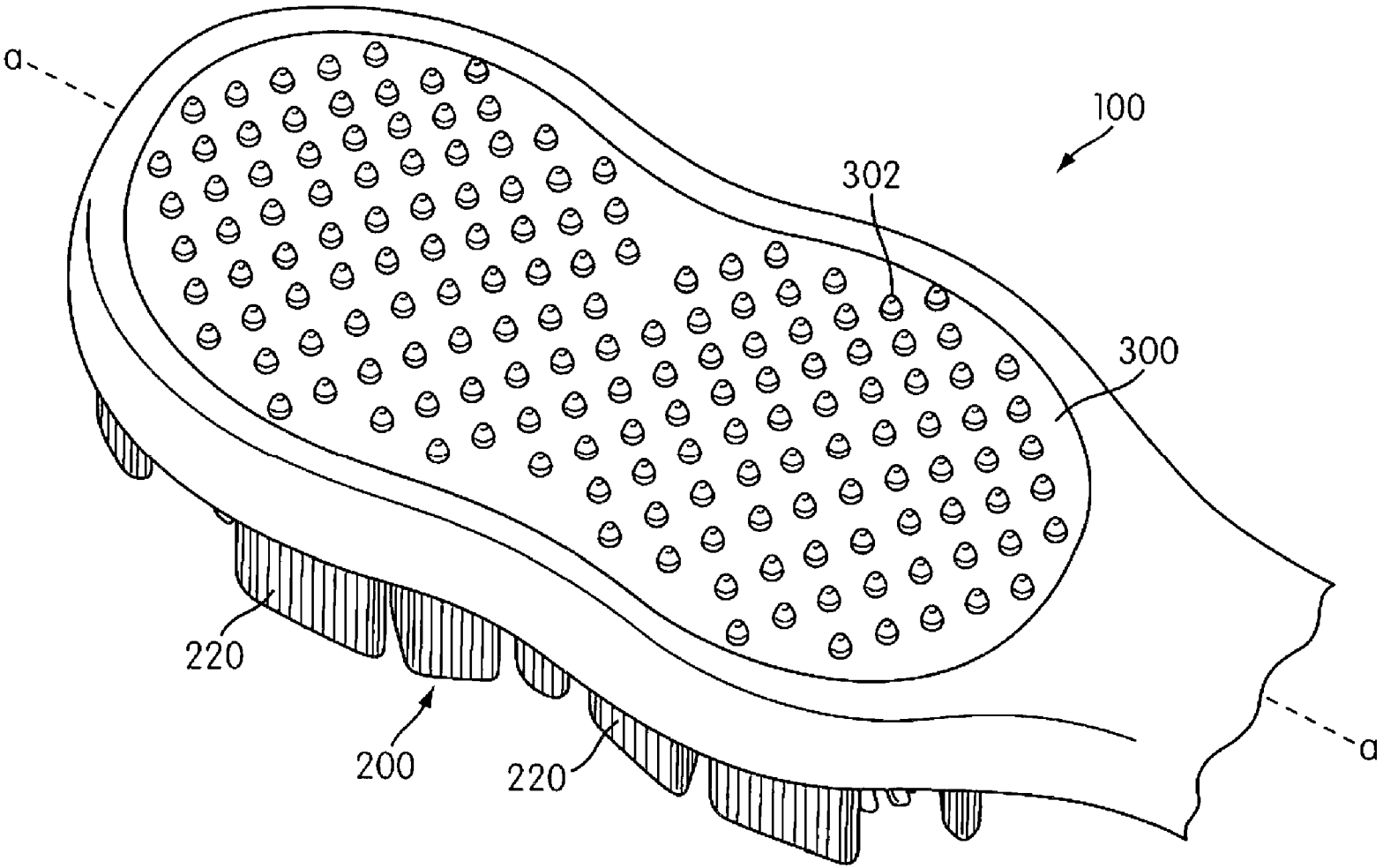
FIG. 7 is a perspective view of an embodiment of a back side of a toothbrush head of FIG. 1.

Referring to FIG. 7, the back side of the toothbrush 100 (e.g., opposite the radial arrays 202) is optionally provided with a tissue cleanser 300 having an undulating arrangement (see FIG. 3). The tissue cleanser 300 is configured with a multiplicity of tissue engaging elements 302, which in the preferred construction are formed as nubs, and which will be described hereinafter for purposes of simplicity as "nubs." As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

When engaged or otherwise rubbed against a tongue surface, for example, nubs 302 provide for gentle engagement with the soft tissue. Moreover, the nubs 302 are preferably soft so as to flex as needed to traverse and clean the tissue surfaces in the mouth. In the preferred construction, nubs 302 are able to flex and bend from their respective vertical axes as lateral pressure is applied during use. This flexing enhances the comfort and cleaning of the soft tissue surfaces.

Figure 8A:
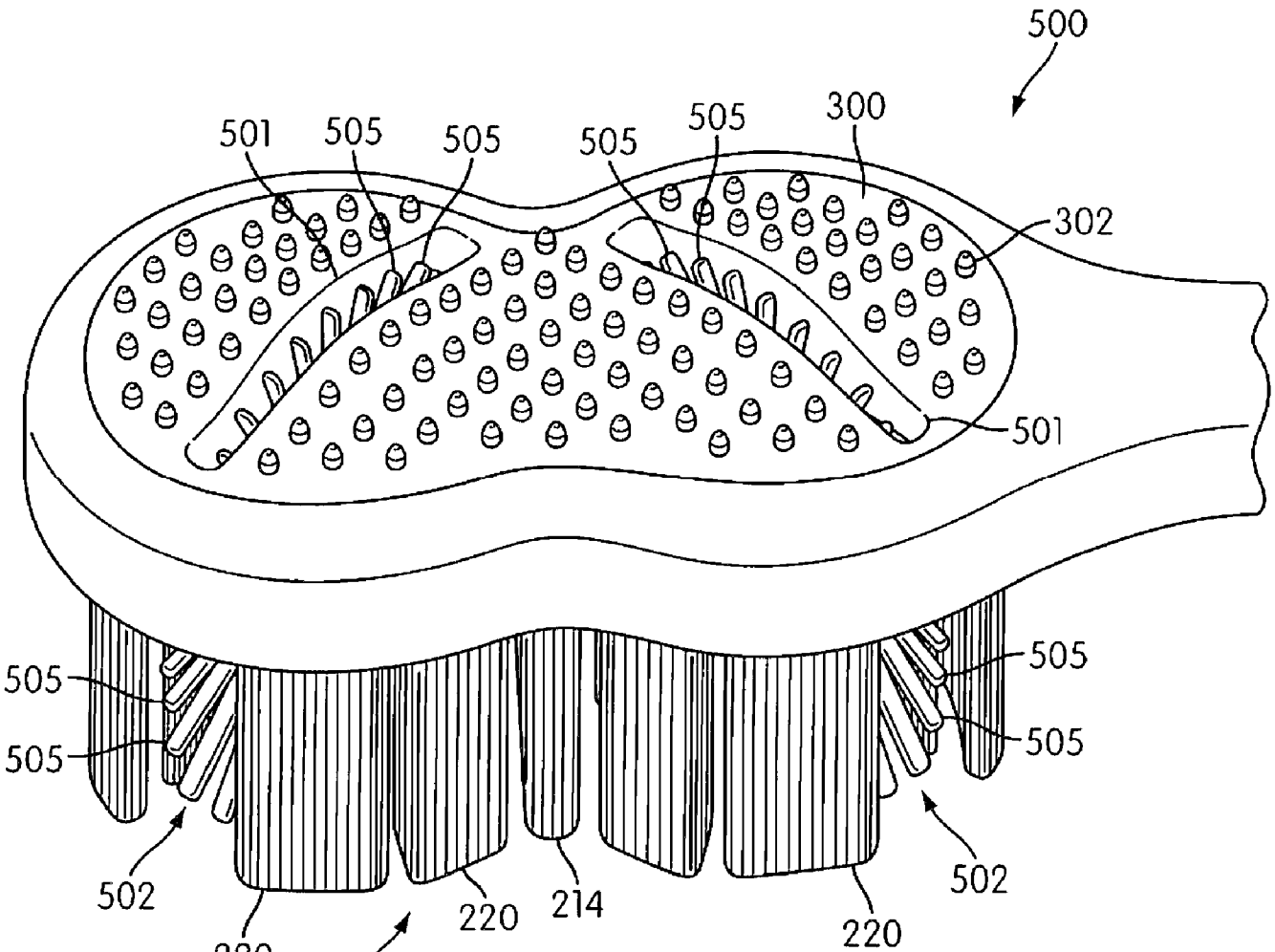
FIGS. 8A and 8B are a perspective views of alternative embodiments of a toothbrush head.
Figure 8B:
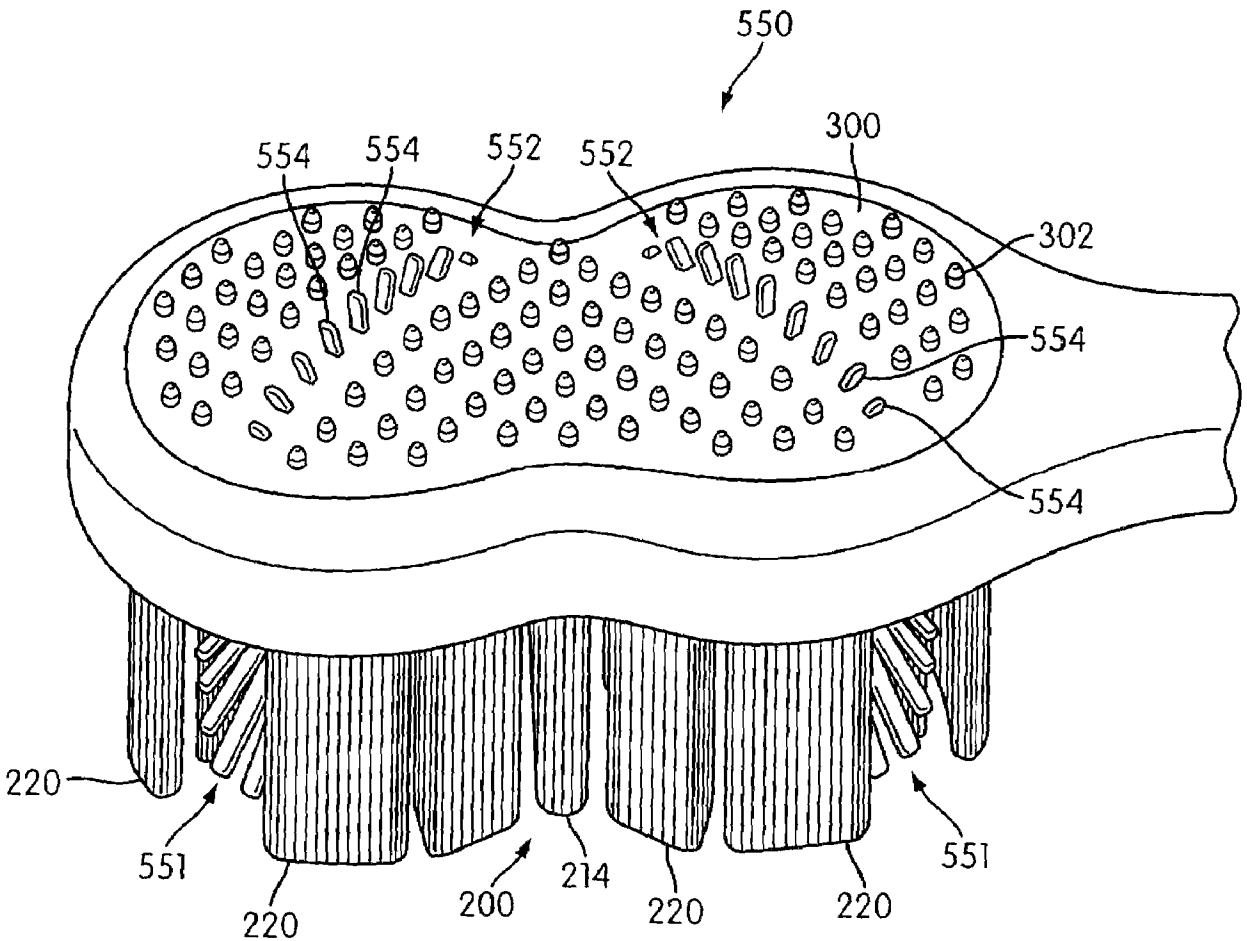

FIGS. 8A and 8B illustrate alternative embodiments of a toothbrush 500, 550 provided with tooth cleaning elements 200 as the embodiment of FIG. 1. In FIG. 8A, to facilitate cleaning action on the back surface of a toothbrush head 105, a radial array 502 can be configured in pivoting arrangement to allow the tips of the spokes 505 to protrude through an opening 501. In the pivoting arrangement, the stem is provided for flexing of the spokes from side-to-side within the opening 501. In this arrangement, a pivoting motion created in the radial array 502 results in pivoting motion on both sides of the brush head. In one embodiment, tissue cleanser 300 can be provided on the back side of the head 105 with opening 501. In one embodiment, radial array 551 is provided in a non-pivoting arrangement. In FIG. 8B, the opposite side of the head 105 can have a second radial array 552 separate from the radial array 551. The spokes 554 of radial array 552 extends outwardly from the base of the head 105 and through the tissue cleanser 300. Hence, spokes 554 are intermixed with nubs 302. In this construction, the second radial array has an appearance of extending through the head 105 to match with the radial array 551 on the other side of the head 105.

Figure 9:
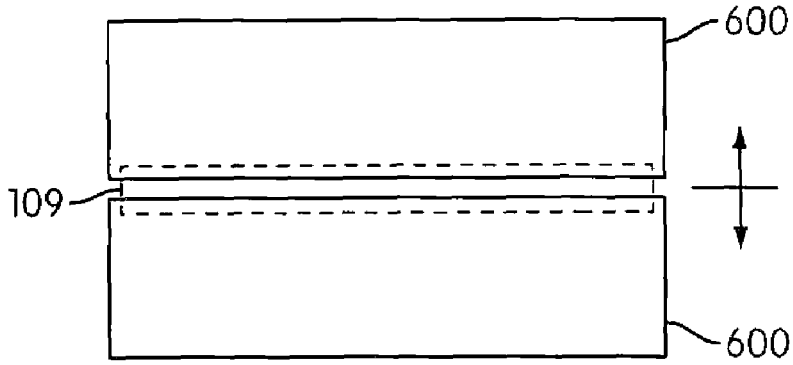
FIG. 9 is a side view of an embodiment of a mold construction of a manufacturing operation.
Figure 10:
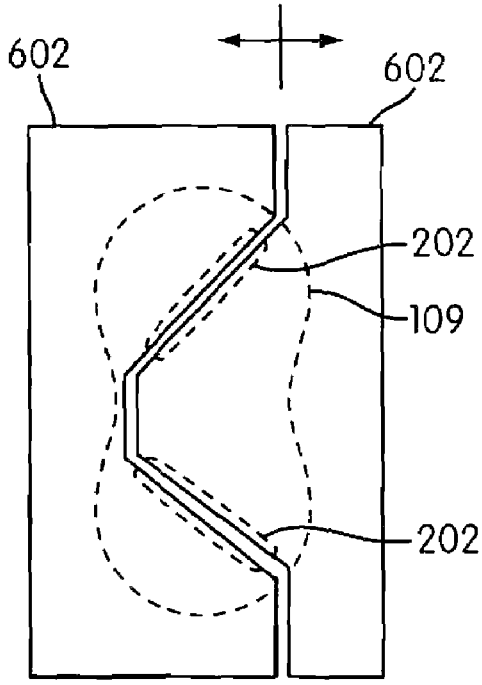
FIG. 10 is a plan view of an embodiment of a mold construction of a manufacturing operation.

Referring to FIGS. 9 and 10, the radial array 202 is preferably manufactured to be integral with the base plate 109 in a two shot molding operation. This operation eliminates the need to assemble loose parts as in conventional toothbrushes with wheels or rotating elements in the head. Hence, the mold process provides an efficient manufacturing operation and the ability to create radial tooth cleaning elements that allow deeper penetration between interproximal spaces between the teeth.

A benefit of the unitary of construction of the base plate 109 and radial array 202 and the associated manufacturing process is the elimination of "bristle dead space" on the head 105. The manufacturing process achieves the radial array mounting in the "shadow" of the array's thickness, allowing bristle tufts to be placed in close proximity. In FIG. 9, a base plate 109 of a toothbrush head 105 is formed in which mold halves 600 move in a linear or a non-linear direction to abut each other. In a preferred operation, the linear direction is vertical. A molding material is applied in the void space between the mold halves. Subsequently, the mold halves 600 separate to release the formed base plate 109. The mold halves move together in a direction that may be vertical, horizontal or at an angle. In FIG. 10, the base plate 109 is stationary and two mold halves 602 travel parallel to the base plate to provide a side molding operation. The side molding operation forms at least one radial array 202 on the base plate 109. The mold halves 602 forming the radial array move in a linear direction, and have a multi-angled construction to form more than one angled array at the same time. Hence, the side molding direction can be perpendicular to the vertical direction of the base plate molding step.

In the molding process, the base plate 109 and radial arrays 202 can be made of the same or a different material. The radial arrays 202 can be molded in a number of different polymers, depending upon the specific desired affects. The radial arrays 206 can have a hardness value of about 13 to 35 Shore A. Very thin radial tooth cleaning elements can be molded in semi-rigid materials such as high durometer thermoplastic elastomer (TPE), LLDPE, or other PP/PE/polyamide based materials. Thicker constructions may use softer materials, such as low to mid durometer TPEs. After the molding process, the bristles are provided on the base plate 109 by an anchor free tuft process. The assembled base plate 109 is then attached to the head pocket which forms the back portion of the brush head 105.

The inventive aspects may be practiced for a manual toothbrush or a powered toothbrush, such as a vibrating head having vibrating radial arrays. In operation, the previously described features, individually and/or in any combination, improves cleaning performance of toothbrushes. This unique combination of elements gives exceptional cleaning power in a compact head space.

What is claimed is:

1. A toothbrush, comprising:

a head;

a radial array of tooth cleaning elements being integrally molded with the head; and a tongue cleanser on one side of the head and the radial array is disposed on the opposite side of the head, wherein the tongue cleaning cleanser further comprises a second radial array having an appearance of extending through the head to match with the radial array on the opposite side of the head.

2. The toothbrush according to claim 1, wherein the radial array includes a fluid retaining portion.

3. The toothbrush according to claim 2, wherein the tooth cleaning elements include a sidewall portion which extends from the fluid retaining portion.

4. The toothbrush according to claim 2, wherein adjacent tooth cleaning elements and the fluid retaining portion define a channel.

5. The toothbrush according to claim 1, wherein the head further comprises a plurality of bristles defining an outer brushing surface.

6. The toothbrush according to claim 5, wherein the outer brushing surface is chamfered.

7. The toothbrush according to claim 1, wherein the head further includes a longitudinal axis and the radial array being disposed at an angle to the longitudinal axis.

8. The toothbrush according to claim 7, wherein the tooth cleaning elements are oriented generally perpendicular to the longitudinal axis.

9. The toothbrush according to claim 1, wherein the second radial array is separate from the radial array on the opposite side of the head.

10. The toothbrush according to claim 1, wherein the tooth cleaning elements have a hardness value of about 13 to 35 Shore A.

11. The toothbrush according to claim 1, further comprising a plurality of radial arrays.

12. The toothbrush according to claim 1, wherein the radial array is spaced from a head surface by an upstanding biasing member.

13. A toothbrush, comprising:

a head;

a biasing member extending from the head and having an off-set pivoting axis above the head; and a radial array of tooth cleaning elements attached to an end of the biasing member.

14. The toothbrush according to claim 13, wherein the radial array includes a joining segment.

15. The toothbrush according to claim 14, wherein adjacent tooth cleaning elements and the joining segment define a channel.

16. The toothbrush according to claim 15, wherein the head further comprises a plurality of bristles defining an outer brushing surface.

17. The toothbrush according to claim 13, wherein the head further includes a longitudinal axis and the radial array being disposed at an angle to longitudinal axis.

18. The toothbrush according to claim 17, wherein the tooth cleaning elements and a biasing member are generally perpendicular to the longitudinal axis.

19. The toothbrush according to claim 13, wherein the head further includes a tongue cleanser on one side of the head and the radial array is disposed on the opposite side of the head.

20. The toothbrush according to claim 13, wherein the biasing member has a non-linear shape.

* * * * *